US005682718A

United States Patent [19]

Bennewitz et al.

[11] Patent Number: 5,682,718

[45] Date of Patent: Nov. 4, 1997

[54] METHOD AND APPARATUS FOR DRAWING OFF A YARN AT A SPINNING STATION

[75] Inventors: Andreas Bennewitz, Mönchengladbach; Michael Stein, Ochtendung, both of Germany

[73] Assignee: W. Schlafhorst AG & Co., Moenchengladbach,, Germany

[21] Appl. No.: 526,632

[22] Filed: Sep. 11, 1995

[30] Foreign Application Priority Data

Sep. 10, 1994 [DE] Germany ..... 44 32 240.2

[51] Int. Cl.[6] ..... D01H 13/26

[52] U.S. Cl. ..... 57/263; 57/92; 57/101; 57/261; 57/279; 57/417; 226/97; 226/188; 242/35.6 R

[58] Field of Search ..... 57/261, 263, 279, 57/280, 417, 315, 319, 92, 97, 101; 242/35.6 R; 226/97, 168, 188

[56] References Cited

U.S. PATENT DOCUMENTS

| | | | |
|---|---|---|---|
| 1,992,989 | 5/1935 | Burns | 226/97 |
| 3,297,222 | 1/1967 | McDermott | 226/188 |
| 3,942,579 | 10/1974 | Bartling | 57/263 |
| 4,620,413 | 11/1986 | Anahara et al. | 57/261 |
| 4,656,824 | 4/1987 | Stapfer | 242/35.6 R |
| 5,168,694 | 12/1992 | Raasch et al. | 57/279 |
| 5,463,860 | 11/1995 | Sauer | 57/263 |

FOREIGN PATENT DOCUMENTS

| | | | |
|---|---|---|---|
| 2139684 | 1/1973 | Germany | 57/263 |
| 2620805 | 2/1986 | Germany . | |
| 3917047 | 11/1990 | Germany . | |
| 950821 | 8/1980 | U.S.S.R. | 57/261 |

*Primary Examiner*—William Stryjewski

*Attorney, Agent, or Firm*—Herbert L. Lerner; Laurence A. Greenberg

[57] ABSTRACT

A yarn being spun in a spinning station of a spinning machine is drawn off with an apparatus which includes a pair of rollers for clamping the spun yarn in a gap between the rollers and transporting the spun yarn. The rollers include a draw-off roller being driven continuously in a draw-off direction at a given circumferential speed and a switchable feed roller for contacting the draw-off roller and for being driven through friction by the draw-off roller when contacting the draw-off roller. A method for drawing off the spun yarn includes positioning the yarn to be drawn off between the rollers while the feed roller is not contacting the draw-off roller. The feed roller is driven with a fluid in a circumferential direction and accelerated to a circumferential speed being at most the given circumferential speed. The feed roller is then placed in contact with the draw-off roller. In an apparatus for drawing off the yarn, the feed roller is driven at a predeterminable circumferential speed when the gap between the rollers is opened, it is movable into a raised state and it has one end surface with vane-like protrusions. A compressed air nozzle is to be positioned toward the one end surface of the feed roller while in the raised state. The nozzle is controlled for accelerating the feed roller to a circumferential speed being at most the given circumferential speed, prior to contact with the draw-off roller.

6 Claims, 2 Drawing Sheets

METHOD AND APPARATUS FOR DRAWING OFF A YARN AT A SPINNING STATION

BACKGROUND OF THE INVENTION

Field of the Invention

The invention relates to a method for drawing off a yarn being spun in a spinning station of a spinning machine, through the use of an apparatus for drawing off the yarn which includes a pair of rollers that clamp the spun yarn in a gap between the rollers and transport the yarn, the rollers including a draw-off roller being driven continuously in a draw-off direction and a switchable feed roller for contacting the draw-off roller and for being driven through friction by the draw-off roller. The invention also relates to an apparatus for carrying out the method.

Drawing off of a spun yarn from a spinning station is typical in open-end spinning methods. The apparatus for drawing off a yarn as a rule includes a pair of rollers. One of the rollers is driven continuously in the draw-off direction of the yarn at a speed corresponding to the speed at which the yarn is supplied. A further roller or roll is pressed by spring force against the draw-off roller. It has a friction lining on its periphery and is driven by the driven draw-off roller. The yarn to be fed is clamped in the gap between the rollers. During spinning, the two rollers are in contact with one another and rotate in opposite directions.

In piecing, the pair of rollers is open as a rule. In other words, the feed roller is lifted away from the draw-off roller. Since the draw-off roller is driven continuously at a speed that remains constant, it cannot be used during the piecing operation. The draw-off of the spinning station after piecing is carried out through the use of a service device, which is a so-called piecing carriage, or in combination with it by a takeup bobbin. Once a spinning speed is reached, the piecing carriage passes the yarn to the pair of draw-off rollers. To that end, the yarn is placed in the gap between rollers, and the feed roller is placed against the draw-off roller.

Once the feed roller that has come to a standstill is put in contact with the draw-off roller, it must be accelerated by friction from a standstill to the circumferential speed of the draw-off roller. Although the acceleration time is quite short, nevertheless during that time the yarn is drawn off at a slower speed than usual. Moreover, it is still exposed to increased friction. As a result, yarn flaws or breaks are possible.

A method and an apparatus for avoiding such flaws are already known from German Published, Non-Prosecuted Application DE 39 17 047 A1, corresponding to U.S. Pat. No. 5,168,694. The feed roller is not raised completely from the draw-off roller for piecing but instead is tilted in such a way that the gap between the rollers is enlarged, but one edge of the peripheral surface remains in contact with the draw-off roller.

The apparatus for drawing off the yarn is expensive in engineering terms and is vulnerable to malfunction, because of the feed roller equipped with a tilting mechanism.

SUMMARY OF THE INVENTION

It is accordingly an object of the invention to provide a method and an apparatus for drawing off a yarn at a spinning station, which overcome the hereinafore-mentioned disadvantages of the heretofore-known methods and apparatuses of this general type and which provide a structurally simple apparatus for drawing off the yarn that effectively prevents the occurrence of the yarn flaws described above.

With the foregoing and other objects in view there is provided, in accordance with the invention, a method for drawing off a yarn being spun in a spinning station of a spinning machine, with an apparatus for drawing off the yarn which includes a pair of rollers for clamping the spun yarn in a gap between the rollers and transporting the spun yarn, the rollers including a draw-off roller being driven continuously in a draw-off direction at a given circumferential speed and a switchable feed roller for contacting the draw-off roller and for being driven through friction by the draw-off roller when contacting the draw-off roller, the method which comprises positioning the yarn to be drawn off between the draw-off roller and the feed roller while the the feed roller is not contacting the draw-off roller; driving the feed roller with a fluid in a circumferential direction and accelerating the feed roller to a circumferential speed being at most the given circumferential speed of the draw-off roller; and then placing the feed roller in contact with the draw-off roller.

In accordance with another mode of the invention, there is provided a method which comprises carrying out the step of driving the feed roller by blowing compressed air as the fluid against a vane-like protrusion disposed on one end surface of the feed roller, and stopping the compressed air once the feed roller has been placed in contact with the draw-off roller.

With the objects of the invention in view, there is also provided an apparatus for drawing off a yarn from a spinning station of a spinning machine, comprising a pair of rollers for clamping a spun yarn in a gap between the rollers and for transporting the yarn; the rollers including a draw-off roller being driven continuously in a draw-off direction at a given circumferential speed, and a switchable feed roller for contacting the draw-off roller, for being driven at a predeterminable circumferential speed when the gap between the rollers is opened and for being moved into a raised state; the feed roller having one end surface with vane-like protrusions; a compressed air nozzle to be positioned toward the one end surface of the feed roller with the feed roller in the raised state; and the compressed air nozzle being controlled for accelerating the feed roller to a circumferential speed being at most the given circumferential speed of the draw-off roller, prior to contact with the draw-off roller.

Before the feed roller is placed against the draw-off roller, according to the invention a fluid, for instance compressed air, is blown at the feed roller, and the feed roller is accelerated in such way that its circumferential speed at most reaches the circumferential speed of the draw-off roller.

Compressed air is an operating medium that is present anyway in textile machines. It therefore requires no major effort to equip the service device that carries out the piecing with the compressed air nozzle, which can be an accessory of the feed roller. Before the feed roller is put in contact with the draw-off roller, the compressed air nozzle aimed at the feed roller can expel a surge of compressed air. This sets the feed roller at which the surge is aimed into rotation.

By suitable metering of the surge of compressed air, the circumferential speed of the feed roller can be made to approximately match the circumferential speed of the draw-off roller. Even if the circumferential speed of the draw-off roller is not entirely reached, nevertheless upon contact of the already rotating feed roller with the draw-off roller, a substantial portion of the energy to be brought to bear on the feed roller to accelerate it is saved. Moreover, the friction between the yarn, which after all is already being fed at the spinning speed, and the feed roller to be accelerated from a standstill, is reduced considerably. According to the invention, it is no longer a non-moving feed roller that meets the already moving yarn but rather a feed roller having a speed which has been adapted approximately to the speed of the yarn. In the ideal case, the feed roller to be put in contact is already at the circumferential speed of the draw-off roller.

The feed roller has vane-like protrusions on its end surface at which the compressed air blows, setting the feed roller into rotation. Before the feed roller is placed against the draw-off roller, the compressed air is stopped, so that the feed roller, in matching its circumferential speed to the circumferential speed of the draw-off roller, is not impeded by being subjected to compressed air.

The duration and intensity of the compressed air surge can be controlled in such a way that the feed roller in an ideal case reaches the rotary speed of the draw-off roller. It would not be advantageous if the draw-off roller were to run more slowly than the feed roller pressing against it, because then the yarn would rip from a rubbing effect, or would at least be thinned at that point.

In accordance with another feature of the invention, the feed roller has a peripheral surface and a retainer, the vane-like protrusions extend from the retainer radially outward to the peripheral surface, and the retainer has a device for disposing and fastening to the end surface of the feed roller.

In accordance with a further feature of the invention, in order for the yarn not to be impeded in its yarn travel, it is advantageous for the vane-like protrusions to be covered by a friction lining that surrounds the peripheral surface of the feed roller. The vane-like protrusions must not end at the circumferential level of the feed roller, because otherwise, upon indenting the elastic friction lining of the feed roller, the vane-like protrusions would hit the draw-off roller.

In accordance with a concomitant feature of the invention, the vane-like protrusions extend radially inward, as seen from the peripheral surface.

Although the invention is illustrated and described herein as embodied in a method and an apparatus for drawing off a yarn at a spinning station, it is nevertheless not intended to be limited to the details shown, since various modifications and structural changes may be made therein without departing from the spirit of the invention.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
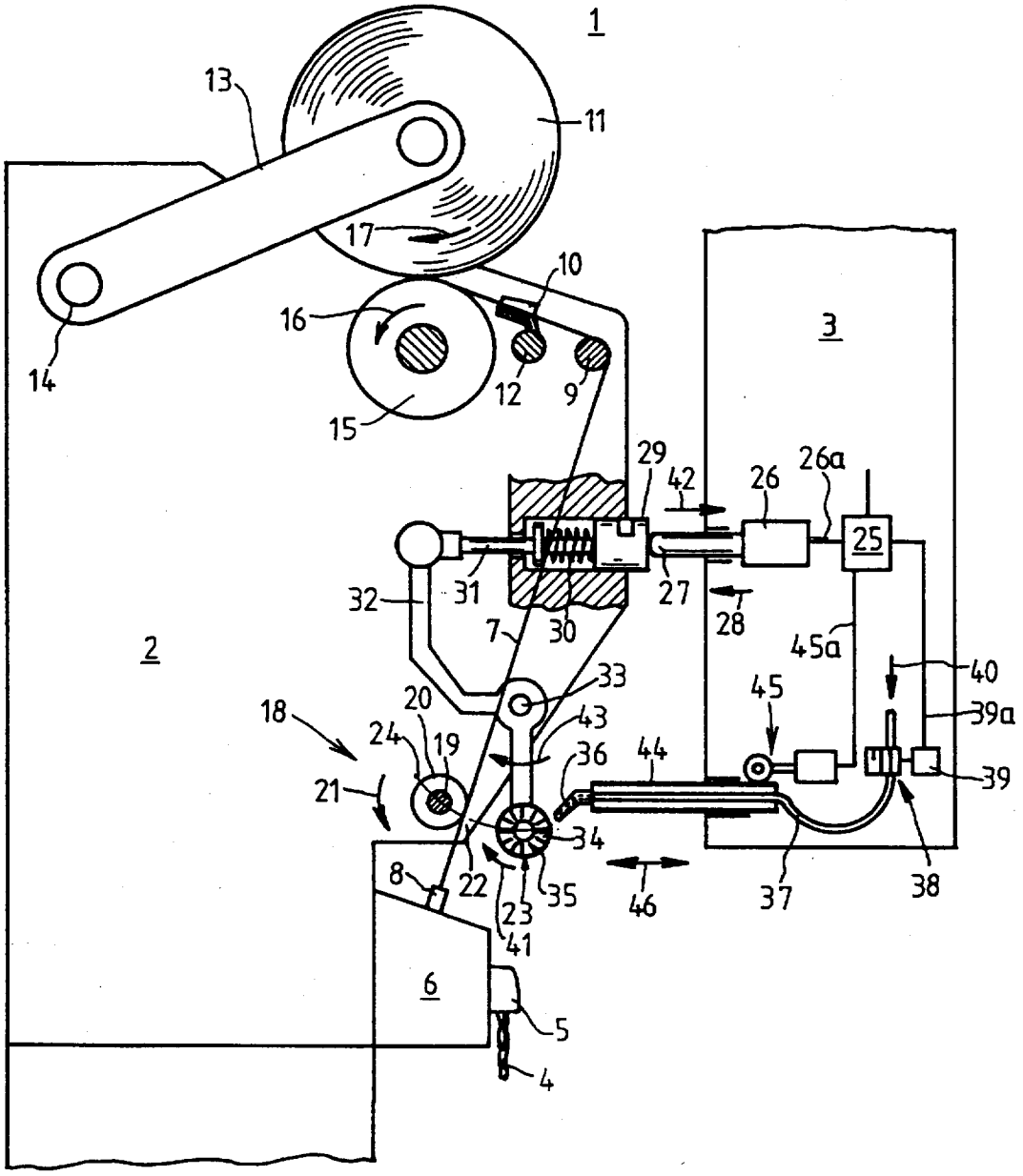
FIG. 1 is a fragmentary, diagrammatic, side-elevational view of a spinning station of an open-end spinning machine with an apparatus according to the invention.

Referring now to the figures of the drawing in detail and first, particularly, to FIG. 1 thereof, there is seen one spinning station 2 of an open-end spinning machine 1 in a side view. Only the characteristics contributing to comprehension of the invention are shown and described herein.

A service device 3, which is a piecing carriage that has carried out piecing, has positioned itself in front of the spinning station. At the spinning station 2, sliver 4 from a non-illustrated can is drawn into a spinning box 6 through a condenser 5 and there is spun in a known manner to make a yarn 7, which is drawn off from a draw-off tubule 8.

In the present exemplary embodiment, a yarn travel has just been re-established by the piecer carriage 3. The yarn travels from the draw-off tubule over a yarn guiding and storage wire 9 to a yarn guide 10, which deposits the yarn in cross-wound layers on the periphery of a cross-wound bobbin or cheese 11. The yarn guide 10 is secured to a rod 12 extending along the machine. This rod 12 serves as a yarn guide rod for the reciprocating motion of the yarn guide that lays the yarn. The cheese 11 is supported in a creel 13, which is supported in a frame of the spinning station 2 at a pivot point 14. The cheese 11 presses with its peripheral surface on a winding roller 15, which rotates in a direction of rotation 16 and drives the cheese 11 that is contacting it, in a winding direction 17, by friction.

In order to enable the spun yarn to be drawn off from the spinning box at constant speed, a pair of draw-off rollers 18 is provided. A centrally driven draw-off shaft 19 extends through the machine, along all of the spinning stations. A draw-off roller 20 which is disposed on and firmly joined to the draw-off shaft 19 is disposed at each spinning station. The draw-off roller rotates in the direction of an arrow 21 with a circumferential speed that enables an optimal drawing-off of the spun yarn.

FIG. 1 shows a situation after the yarn has been pieced. Although yarn travel has been re-established and the yarn 7 is already present at the draw-off roller 20, nevertheless a feed roller 23 is still in an open position. Drawing off of the yarn can occur only when the feed roller, which is lined with a friction lining, is pressed with spring force against the draw-off roller, in a known manner. In order to enable the piecing carriage 3 to carry out the piecing operation by devices that are known and therefore not shown herein, the pair of draw-off rollers had been opened. The feed roller 23 was pivoted along an arc 24 away from the draw-off roller. To that end, a signal was issued by a control unit 25 to an actuator 26 over a signal line 26*a*. The signal was for a lifter button 29 to be pressed through the use of an actuating prong 27, which was moved outward in the direction of an arrow 28. The lifter button 29 is pressed counter to the force of a spring 30 and has a pressure rod 31, through which the lifter button 29 actuates one end of a pivot lever 32. This lever 32 is supported at a pivot point 33 in a housing of the spinning station 2 and carries the feed roller 23 on its other end.

The feed roller 23 has vane-like protrusions 35 on an end surface 34 thereof. A compressed air nozzle 36 is positioned at the feed roller 23. The compressed air nozzle 36 is connected to a compressed air line 37, which leads to a non-illustrated compressed air supply in the piecing carriage 3. A switchable valve 38 is disposed in the compressed air line 37 and can be opened and closed by an actuator 39 over a signal line 39*a* from the control unit 25 of the piecing carriage 3. In the present exemplary embodiment, the valve 38 is opened, and as is symbolized by an arrow 40, compressed air flows to the nozzle 36. The compressed air strikes the vane 35 on the end surface 34 of the feed roller 23 and sets it into rotation in the direction of an arrow 41. The feed roller 23 rotates in the opposite rotary direction from the draw-off roller 21.

Once the feed roller 23 has been set into rotation and the circumferential speed of the feed roller has almost or actually reached the circumferential speed of the draw-off roller 20, it can be pressed against the draw-off roller 20. To that end, the lifter knob 29 must be released. The actuator 26 receives a command from the control unit 25 over the signal line 26*a* to retract the actuating prong 27 in the direction of an arrow 42. As a result, the pressure rod 31 is retracted under the pressure of the spring 30, and the pivot lever 32 is pivoted about the pivot point 33, thus swiveling the feed roller 23 against the draw-off roller 20 in the direction of an arrow 43, causing it to rest thereon.

Upon the release of the lifter knob 29, the valve 38 is simultaneously actuated through the control unit 25 and blocks off the supply of compressed air. The compressed air nozzle 36 is mounted on a retainer 44. The retainer can be retracted and projected through the use of a drive 45, as is suggested by a double arrow 46. Once the feed roller 23 has been set to rotation through the use of the compressed air surge and the valve 38 has been closed, a command is issued by the control unit 25 to the drive 45 over a signal line 45*a* to retract the retainer 44 with the nozzle 36. Once the piecing operation has been successfully completed, the piecing carriage 3 then continues its travel along the spinning stations of the spinning machine.

FIGS. 2*a* and 2*b* and 3*a* and 3*b* show exemplary embodiments of the feed rollers according to the invention.

Figure 2A:
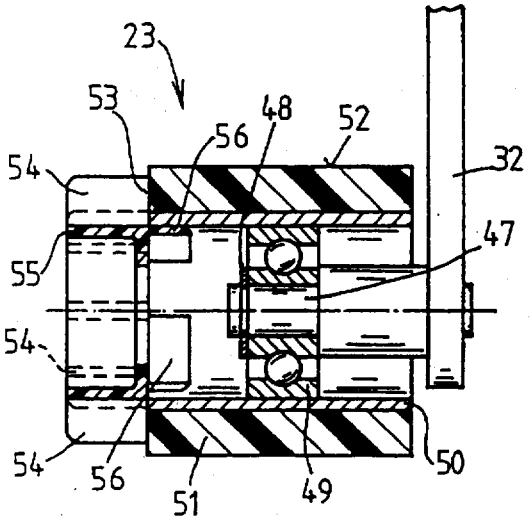
FIG. 2*a* is a fragmentary, longitudinal-sectional view of a feed roller with vanes on an end surface.

In FIG. 2*a*, the pivot lever 32 is disposed on a shaft 47 and carries a ball bearing 49 secured by a securing ring 48. It is shrunk into a tubular sleeve 50, which carries a friction lining 51 on its periphery. The feed roller 23 rests with this friction lining disposed against the draw-off roller 20. Vane-like protrusions 54 in the form of radially outward-pointing thinned ribs are disposed on an end surface 53. These ribs are distributed uniformly over the periphery on the end surface 53. In the present exemplary embodiment, there are eight ribs. The ribs 54 do not extend all the way to a peripheral surface 52 of the friction lining 51, so that when the elastic friction lining 51 contacts the draw-off roller 20 they will not touch it. The ribs are disposed on an annular retainer 55. The annular retainer 55 also has three clamping tabs 56 distributed over its periphery. These clamping tabs are inserted into the sleeve 50. The ribs, annular retainer and clamping tabs can be made of plastic. The clamping action of the clamping tabs 56 can be increased by adhesively bonding them to the tube 50.

Figure 2B:
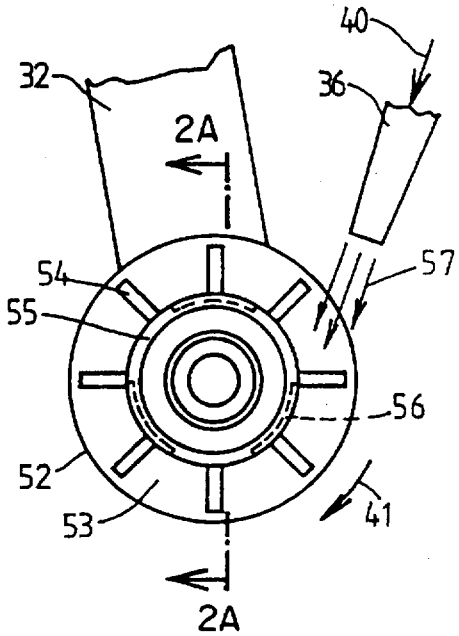
FIG. 2*b* is a fragmentary, front-elevational view of the feed roller of FIG. 2*a;*

FIG. 2*b* shows an elevational view of the feed roller of FIG. 2*a*. A sectional line A—A is taken through the feed roller, and the viewing direction is toward the section. In FIG. 2*b*, the compressed air nozzle 36 is added. The compressed air 40 flows out of the nozzle, as is indicated by arrows 57, and strikes the ribs 54, which act like the vanes of a windmill. The outflowing compressed air 57 sets the feed roller 23 into rotation in the direction of the arrow 41.

The structure of the ribs, annular retainer and clamping tabs make it possible to retrofit existing feed rollers. To that end, the annular retainer 55 merely needs to be clipped with its clamping tabs 56 into the sleeve 50 of a feed roller 23. However, in that case the piecing carriage must be equipped with a compressed air nozzle 36 that can be positioned toward one of these feed rollers 23.

Figure 3A:
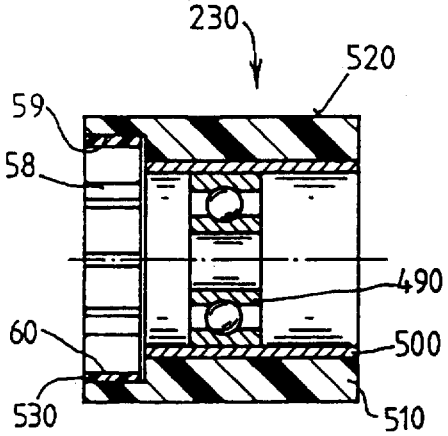
FIG. 3*a* is a fragmentary, longitudinal-sectional view of a feed roller having vanes which are covered by a friction lining.
Figure 3B:
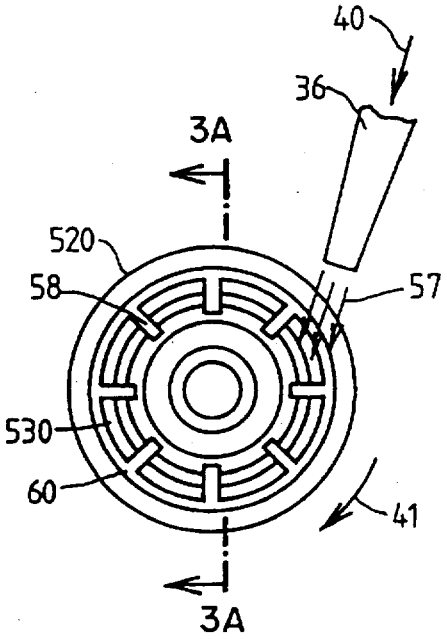
FIG. 3*b* is a fragmentary, front-elevational view of the feed roller of FIG. 3*a*.

FIGS. 3*a* and 3*b* show a further exemplary embodiment of a feed roller according to the invention. A feed roller 230 is distinguished from the preceding exemplary embodiment in that a peripheral surface 520 covers vane-like protrusions 58. As in the preceding exemplary embodiment, a sleeve 500 which is thrust over a ball bearing 490 has a friction lining 510. The illustrated exemplary embodiments differ from one another in terms of the way in which the vane-like protrusions on an end surface 530 are constructed. The friction lining 510 on one end surface of the feed roller 230 has a recess 59. A ring is inserted into this recess 59. The vanes 58 pointing radially inward from one another at equal intervals are disposed on an inner periphery of a ring 60. In the present exemplary embodiment, there are eight vanes.

As can be seen from FIG. 3*b*, the vanes 58 extend only far enough inward to ensure that they afford an engagement surface to the compressed air 57 flowing out of the compressed air nozzle 36. The outflowing compressed air 57 that strikes the vanes 58 sets the feed roller 230 into motion in the direction of the arrow 41. This embodiment has the special advantage that the ribs are integrated into the feed roller in such a way that the yarn finds no engagement surface on the end surface of the pressure roller.

We claim:

1. A method for drawing off a yarn being spun in a spinning station of a spinning machine, with an apparatus for drawing off the yarn which includes a pair of rollers for clamping the spun yarn in a gap between the rollers and transporting the spun yarn, the rollers including a draw-off roller being driven continuously in a draw-off direction at a given circumferential speed and a switchable feed roller for contacting the draw-off roller and for being driven through friction by the draw-off roller when contacting the draw-off roller, the method which comprises:

positioning the yarn to be drawn off between the draw-off roller and the feed roller while the feed roller is not contacting the draw-off roller;

driving the feed roller with a fluid in a circumferential direction and accelerating the feed roller to a circumferential speed less than or equal to the given circumferential speed of the draw-off roller; and then placing the feed roller in contact with the draw-off roller to engage the yarn therebetween and draw off the yarn.

2. The method according to claim 1, which comprises carrying out the step of driving the feed roller by blowing compressed air as the fluid against a vane-like protrusion disposed on one end surface of the feed roller, and stopping the compressed air once the feed roller has been placed in contact with the draw-off roller.

3. An apparatus for drawing off a yarn from a spinning station of a spinning machine, comprising:

a pair of rollers for clamping a spun yarn in a gap between said rollers and for transporting the yarn;

said rollers including a draw-off roller being driven continuously in a draw-off direction at a given circumferential speed, and a switchblade feed roller for contacting said draw-off roller, for being driven at a predeterminable circumferential speed when said switchable feed roller is moved out of contact with said draw-off roller and into a raised state;

said feed roller having one end surface with vane-like protrusions;

a compressed air nozzle to be positioned toward said one end surface of said feed roller with said feed roller in said raised state; and said compressed air nozzle being controlled for accelerating said feed roller to a circumferential speed less than or equal to said given circumferential speed of said draw-off roller, prior to contact with said draw-off roller.

4. The apparatus according to claim 3, wherein said feed roller has a peripheral surface and a retainer, said vane-like protrusions extend from said retainer radially outward to said peripheral surface, and said retainer has a device for disposing and fastening to said end surface of said feed roller.

5. The apparatus according to claim 3, wherein said feed roller has a peripheral surface and a friction lining surrounding said peripheral surface, and said vane-like protrusions are covered by said friction lining.

6. The apparatus according to claim 5, wherein said vane-like protrusions extend radially inward, as seen from said peripheral surface.

* * * * *